US005846166A

United States Patent [19]

Kuo

[11] Patent Number: 5,846,166

[45] Date of Patent: Dec. 8, 1998

[54] STEPPING EXERCISE MECHANISM

[76] Inventor: Hui Kuei Kuo, No. 19, Lane 640, Gien Gong Road, San Min Chu, Kaohsiung, Taiwan

[21] Appl. No.: 58,927

[22] Filed: Apr. 13, 1998

[51] Int. Cl.[6] ..... A63B 69/16; A63B 22/04

[52] U.S. Cl. ..... 482/52; 482/70

[58] Field of Search ..... 482/51, 52, 53, 482/57, 62, 70, 71, 74, 79, 80

[56] References Cited

U.S. PATENT DOCUMENTS 5,529,555 6/1996 Rodgers ..... 482/70
5,540,637 7/1996 Rodgers ..... 482/57
5,577,985 11/1996 Miller ..... 482/52
5,611,756 3/1997 Miller ..... 482/52
5,611,758 3/1997 Rodgers ..... 482/57
5,738,614 4/1998 Rodgers ..... 482/51

*Primary Examiner*—Stephen R. Crow

[57] ABSTRACT

An exercise mechanism includes a beam and a pair of tracks disposed on a base. A pair of foot supports each has a rear end slidably engaged on the tracks and each has a front end pivotally coupled to a lower end of a pair of handles. The handles each has an upper portion pivotally coupled to the beam by a link and each includes a lower middle portion coupled to the beam by a crank for allowing the lower middle portions of the handles to be moved in a circular reciprocating action. The foot supports may be moved forward and rearward by the handles.

5 Claims, 8 Drawing Sheets

STEPPING EXERCISE MECHANISM

BACKGROUND OF THE INVENTION

1. Field of the Invention

The present invention relates to an exerciser, and more particularly to a stepping exercise mechanism.

2. Description of the Prior Art

Typical stepping exercisers comprise a pair of foot pedals having one end pivotally coupled to a base and having the other end movable in a reciprocating action. A pair of handles are secured in place or are pivotally coupled to the foot pedals. However, the handles are normally solidly secured in place or are movable forward and rearward in a pivotal action such that the handles may not be used for exercising the upper muscle groups.

The present invention has arisen to mitigate and/or obviate the afore-described disadvantages of the conventional stepping exercisers.

SUMMARY OF THE INVENTION

The primary objective of the present invention is to provide a stepping exercise mechanism having a pair of handles that may be used for exercising the upper muscle groups of the user.

In accordance with one aspect of the invention, there is provided an exercise mechanism comprising a base including a rear portion and including a beam having a middle portion and an upper portion, a pair of tracks disposed on the rear portion of the base, a pair of foot supports each including a rear portion slidably engaged on the tracks for allowing the rear portions of the foot supports to be moved along the tracks respectively, the foot supports each including a front portion, a pair of handles each including a lower portion pivotally coupled to the front portion of the foot supports and each including an upper middle portion and each including a lower middle portion, a pair of links pivotally coupling the upper middle portions of the handles to the upper portion of the beam, and means for moving the lower middle portion of the handles in a circular and reciprocating action, for allowing the handles to move the foot supports in a forward-rearward reciprocating action.

The handles each includes an upper portion having a hand grip for actuating the handles. The foot supports each includes a wheel secured to the rear portion of the foot supports for slidably engaging with the tracks respectively. The moving means includes a pair of cranks rotatably secured to the middle portion of the beam at a pivot axle, the lower middle portions of the handles are pivotally coupled to the cranks at a pair of pins for allowing the lower middle portions of the handles to be rotated about the pivot axle in the reciprocating action. A resistive force applying means is further provided for applying a resistive force against the foot supports.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
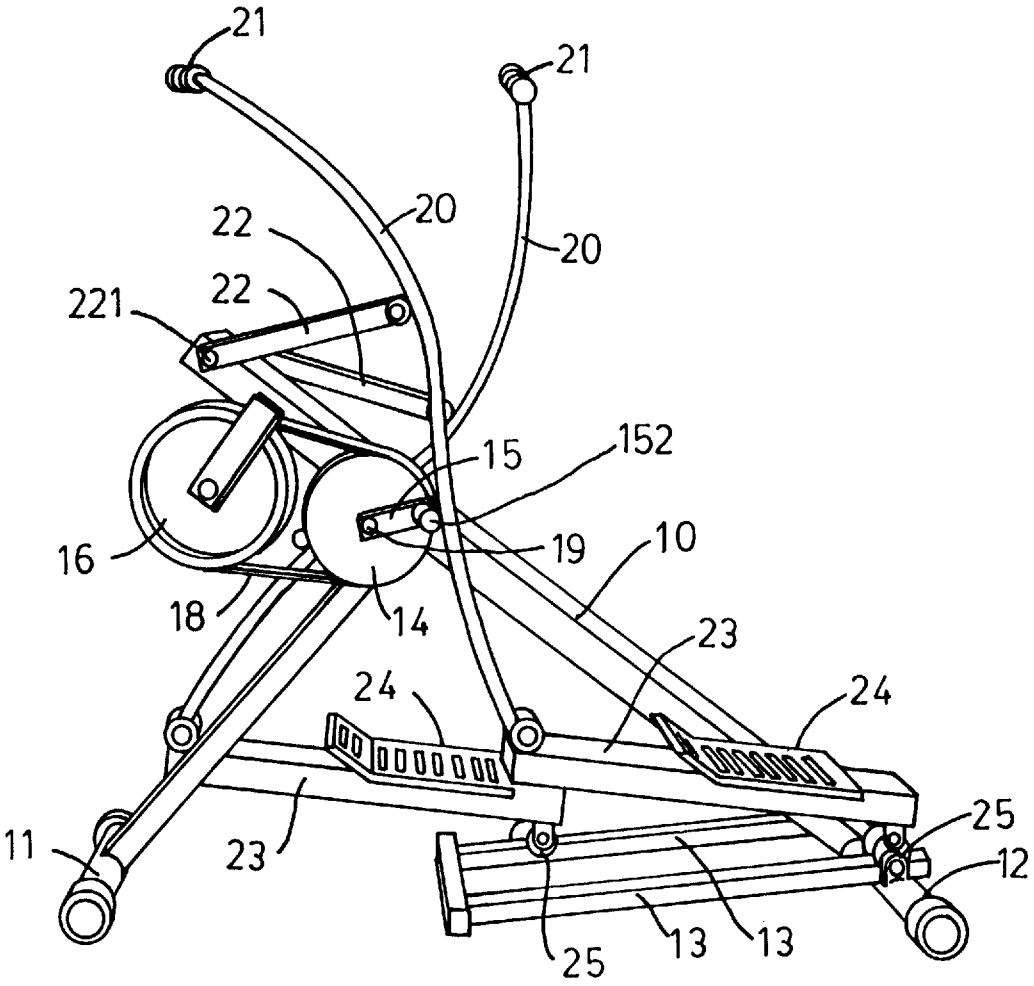
FIG. 1 is a perspective view of a stepping exercise mechanism in accordance with the present invention.
Figure 2:
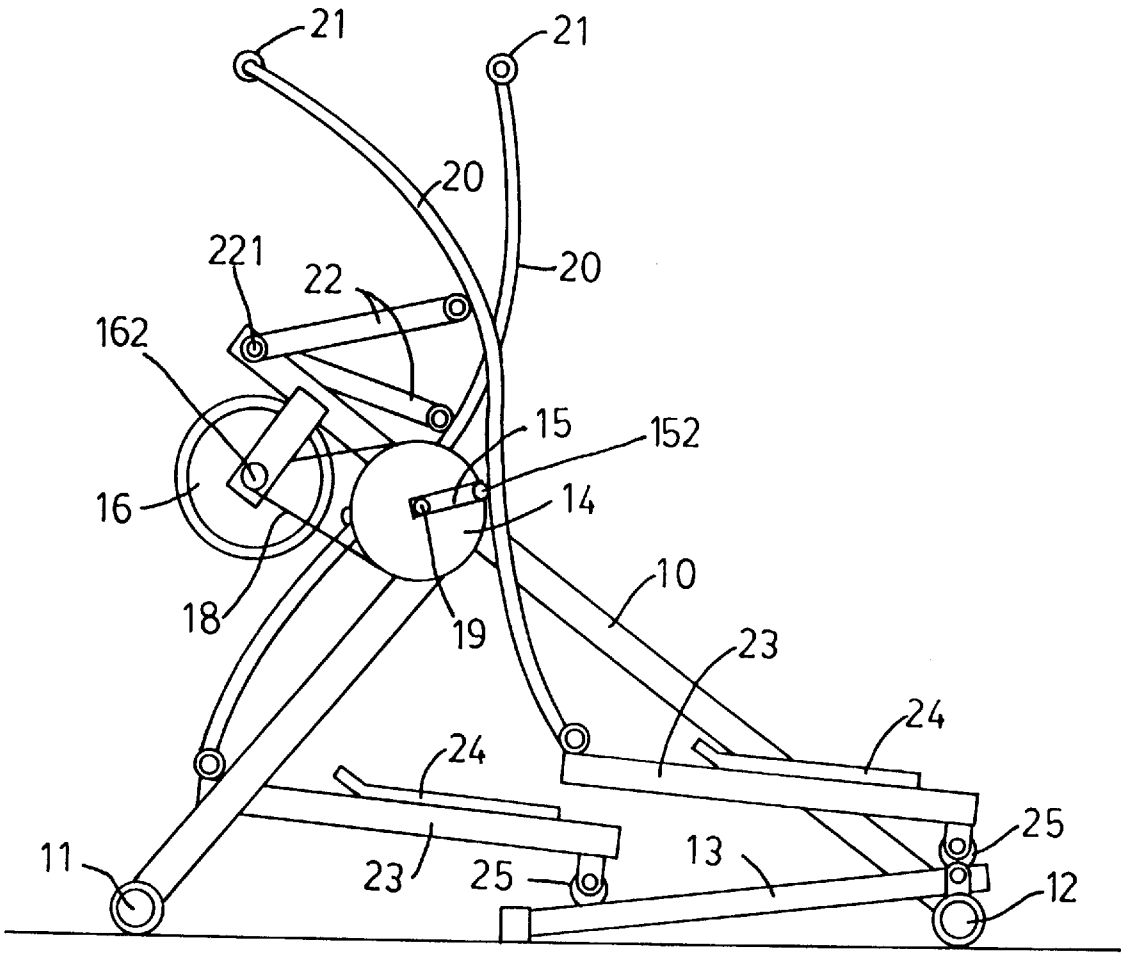
FIGS. 2 and 3 are side views illustrating the operation of the stepping exercise mechanism.
Figure 3:
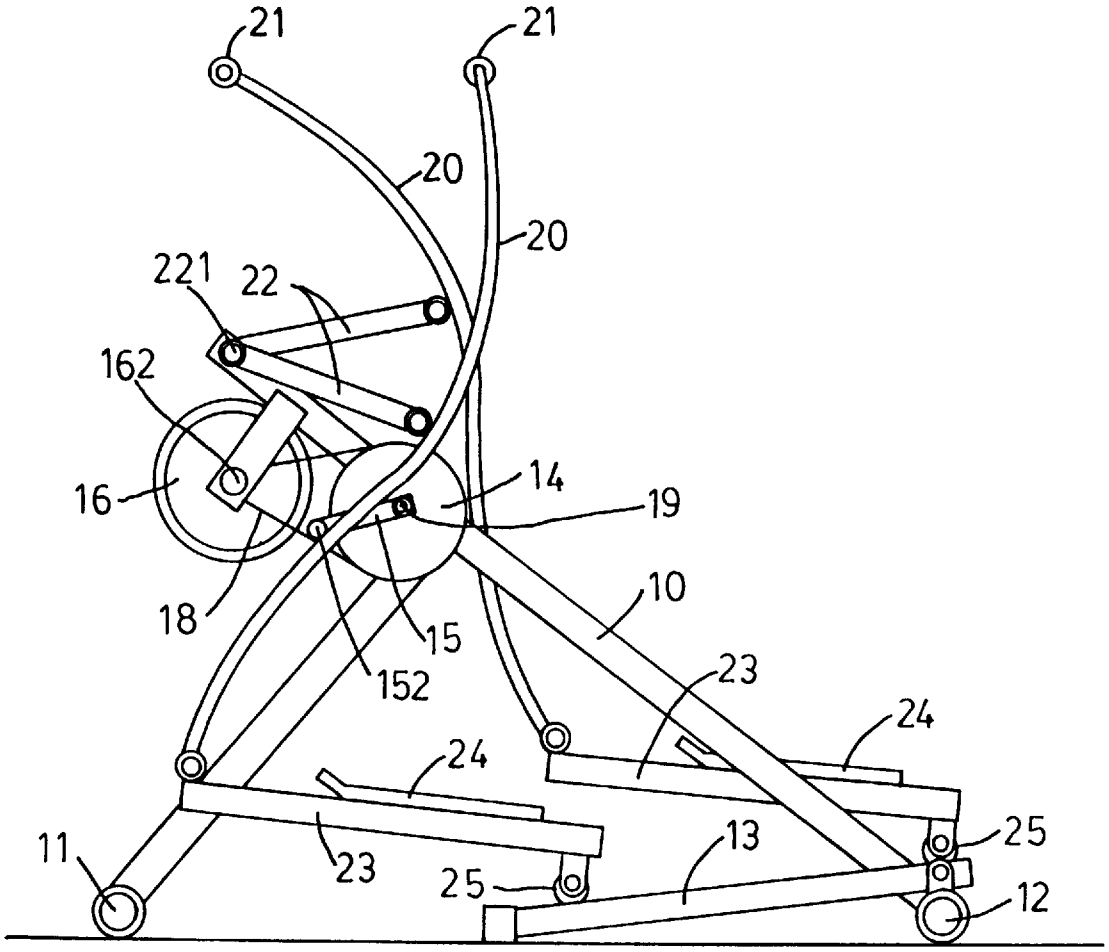
Figure 4:
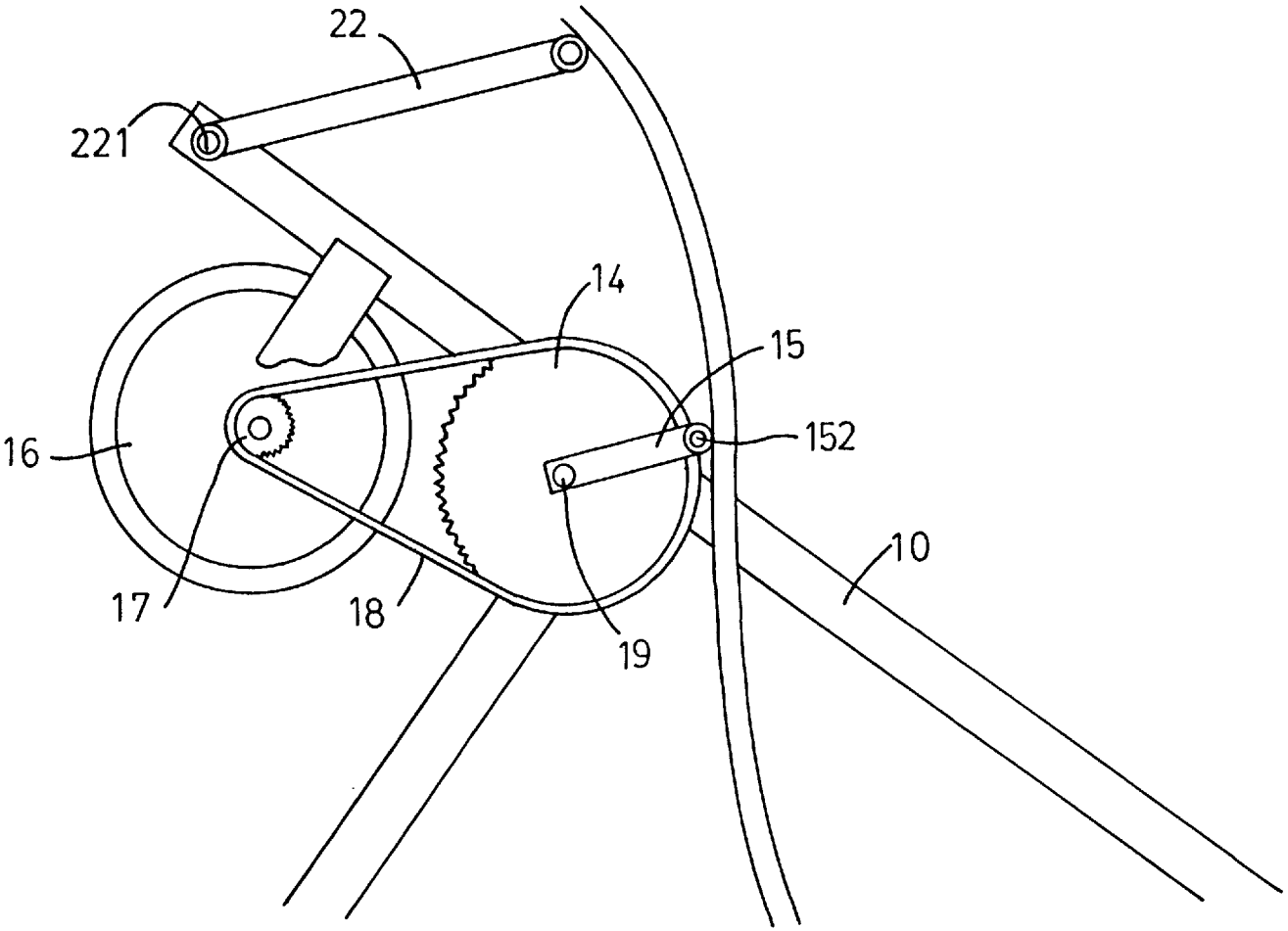
FIG. 4 is a partial side view illustrating another operation of the stepping exercise mechanism.
Figure 5:
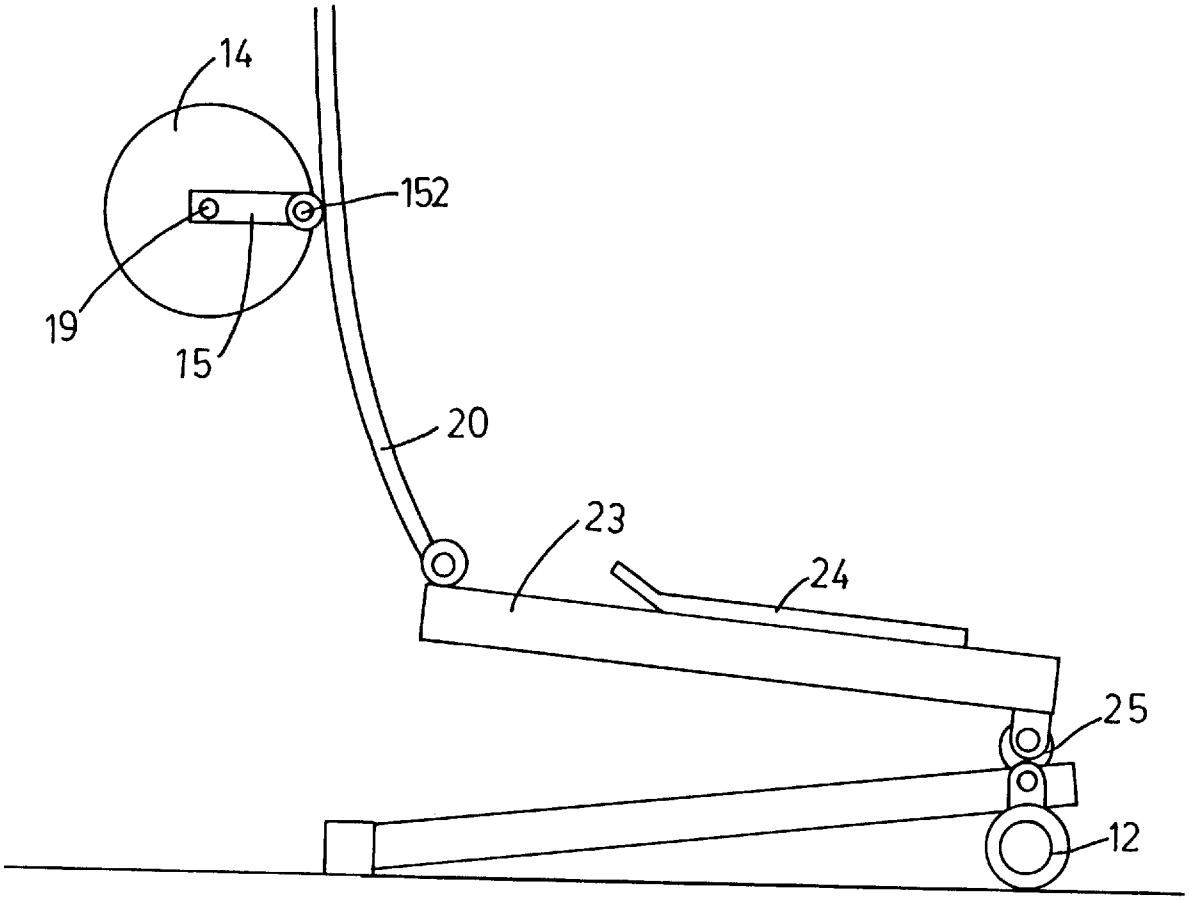
FIGS. 5, 6, 7 and 8 are partial side views showing the operation of the stepping exercise mechanism.
Figure 6:
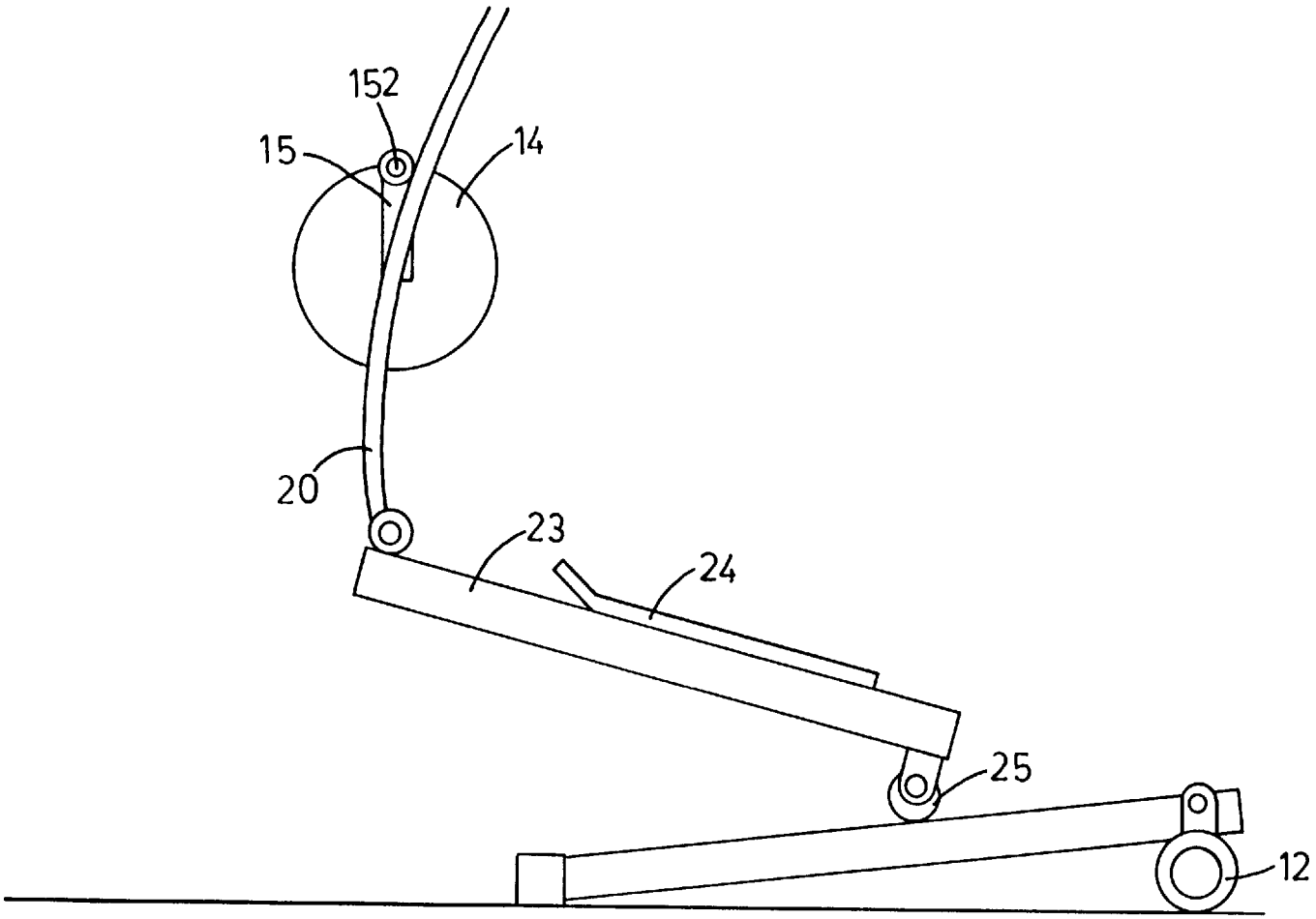
Figure 7:
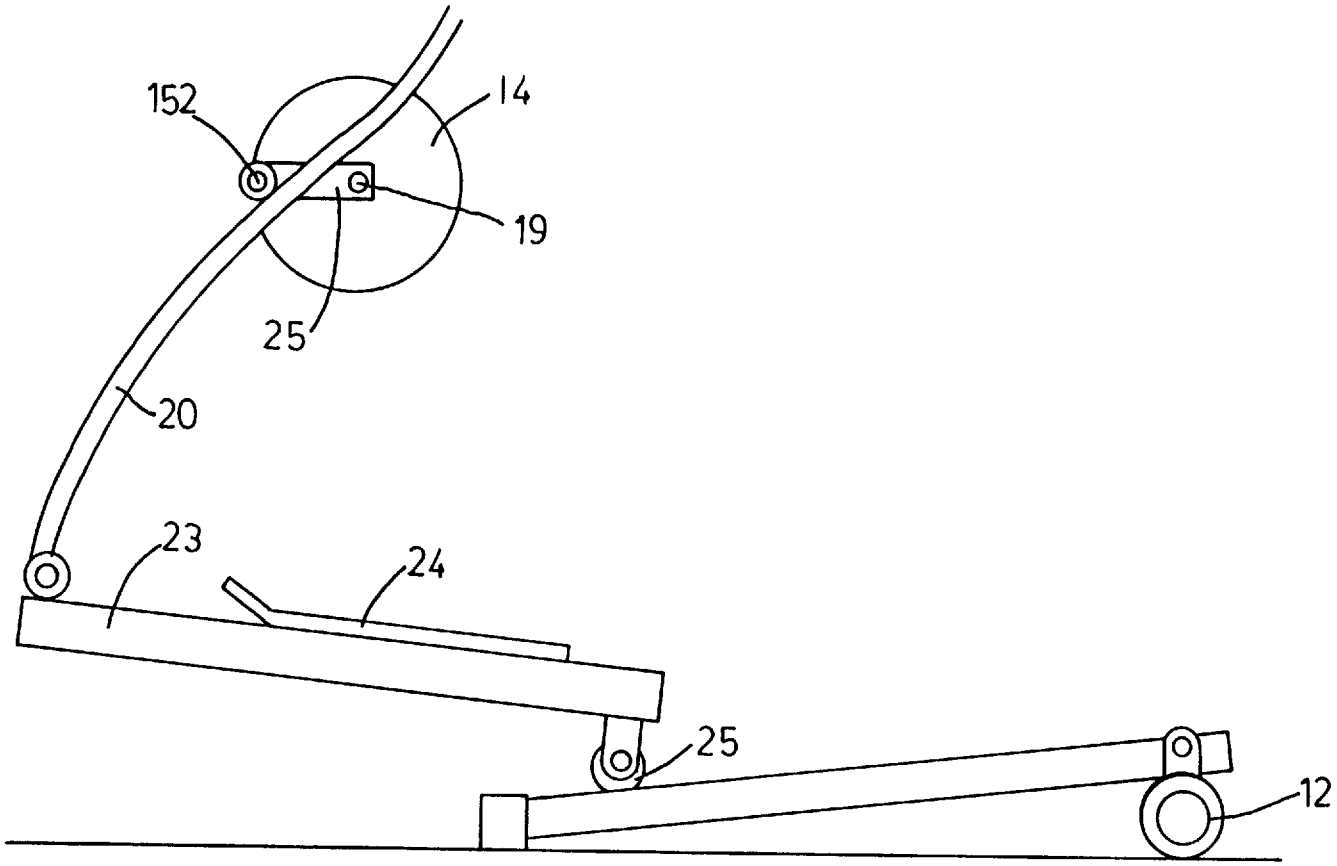
Figure 8:
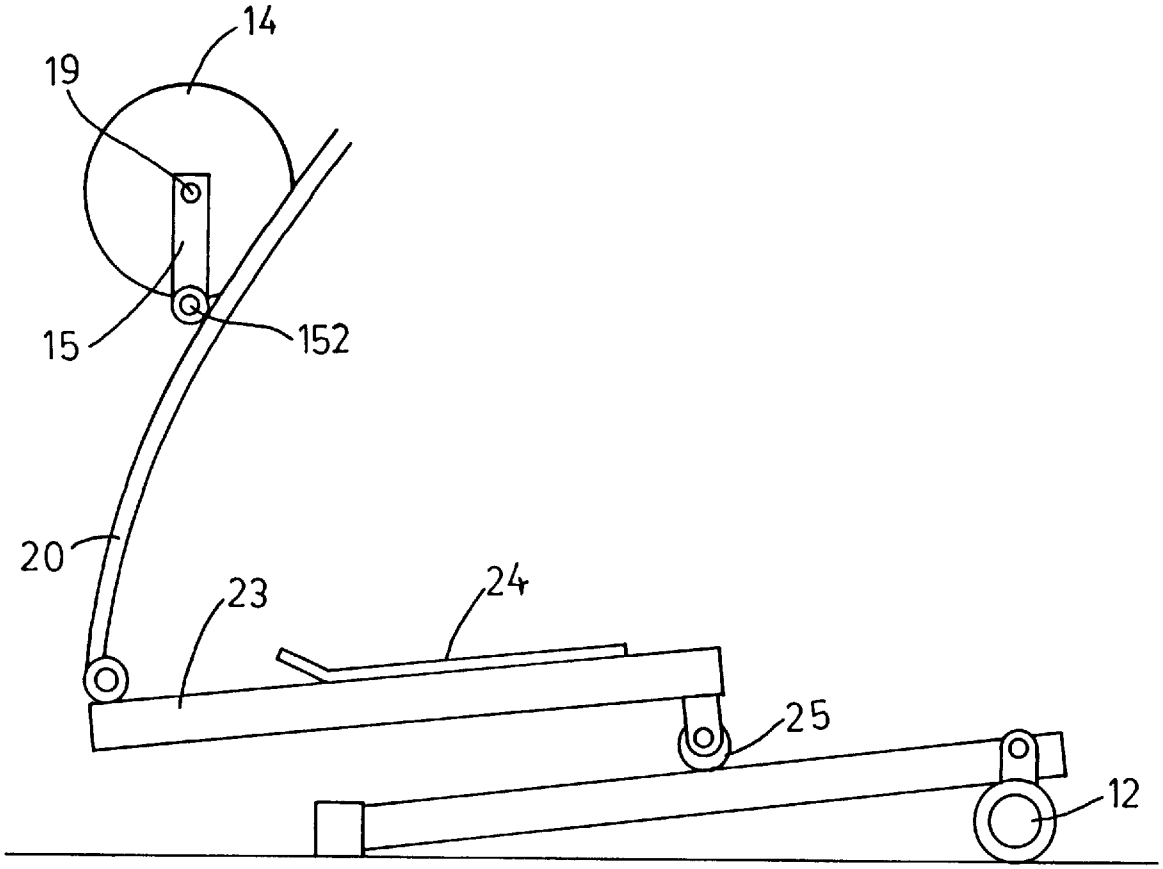

Referring to the drawings, and initially to FIGS. 1–4, a stepping exercise mechanism in accordance with the present invention comprises a base including an inclined beam 10 and two lateral rods 11, 12 provided on the front and the rear portions of the base respectively. A pair of tracks 13 are disposed on the rear portion of the base and secured to the rod 2 and preferably inclined relative to the base. A wheel 14 (FIG. 1) or a sprocket (FIG. 4) and a pair of cranks 15 are rotatably secured to the middle portion of the beam 10 at a pivot axle 19. A wheel or a weight 16 is rotatably secured to the beam 10 and coupled to the wheel 14 by a coupling belt 18 (FIG. 1) or by another sprocket 17 and a chain 18 (FIG. 4). Alternatively, the belt 18 may be coupled to the shaft 162 of the weight 16 (FIGS. 2, 3) for coupling the weight 16 to the wheel 14 and for applying a resistive force against the rotational movement of the wheel 14 and/or the cranks 15.

A pair of handles 20 each has a lower middle portion pivotally coupled to the cranks 15 at a pin 152 and each has an upper middle portion pivotally coupled to the beam 10 by a link 22 and each includes a hand grip 21 secured on top thereof. The links 22 are pivotally coupled to the beams 10 at a pivot spindle 221. The handles 20 each includes a lower portion pivotally coupled to a front end of a foot support 23 which includes a foot pedal 24 disposed on top for engaging with the feet of the user. The foot supports 23 each includes a roller or a wheel 25 secured to the rear portion for slidably engaging with the track 13 and for allowing the rear portions of the foot supports 23 to be moved along the tracks 13 in a forward-rearward reciprocating action. The weight 16 may also apply a resistive force against the movement of the foot supports 23 by the wheel 14 and the handles 20.

In operation, as shown in FIGS. 5–8, the lower middle portions of the handles 20 may be rotated in concert with the cranks 15 along a circular moving path about the pivot axle 19. The upper middle portion of the handles 20 may be rotated relative to the beam 10 about the pivot spindle 221. The rear ends of the foot supports 23 may be moved along the tracks 13 by the wheels 25, such that the front portions and the foot pedals 24 of the foot supports 23 may be moved along an elliptic moving path in a reciprocating action.

It is to be noted that the user may hold the hand grips 21 and may pull and push the hand grips 21 in order to rotate the lower middle portions of the handles 20 and in order to move the front ends of the foot supports 23 in the reciprocation action, such that the user may use the handles 20 to exercise the upper muscle groups.

Accordingly, the stepping exercise mechanism in accordance with the present invention includes a pair of handles that may be used for exercising the upper muscle groups of the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exercise mechanism comprising:

a base including a rear portion and including a beam having a middle portion and an upper portion, a pair of tracks disposed on said rear portion of said base, a pair of foot supports each including a rear portion slidably engaged on said tracks for allowing said rear portions of said foot supports to be moved along said tracks respectively, said foot supports each including a front portion, a pair of handles each including a lower portion pivotally coupled to said front portion of said foot supports and each including an upper middle portion and each including a lower middle portion, a pair of links pivotally coupling said upper middle portions of said handles to said upper portion of said beam, and means for moving said lower middle portion of said handles in a circular and reciprocating action, said foot supports being allowed to be moved forward and rearward by said handles.

2. The exercise mechanism according to claim 1, wherein said handles each includes an upper portion having a hand grip for actuating said handles.

3. The exercise mechanism according to claim 1, wherein said foot supports each includes a wheel secured to said rear portion of said foot supports for slidably engaging with said tracks respectively.

4. The exercise mechanism according to claim 1, wherein said moving means includes a pair of cranks rotatably secured to said middle portion of said beam at a pivot axle, said lower middle portions of said handles are pivotally coupled to said cranks at a pair of pins for allowing said lower middle portions of said handles to be rotated about said pivot axle in the reciprocating action.

5. The exercise mechanism according to claim 1 further comprising means for applying a resistive force against said foot supports.

* * * * *